United States Patent [19]

Berneryd et al.

[11] 4,029,922

[45] June 14, 1977

[54] OPERATING DEVICE FOR ENCLOSED HIGH VOLTAGE CIRCUIT BREAKERS

[75] Inventors: Sten Berneryd; Per-Olof Grune, both of Ludvika, Sweden

[73] Assignee: ASEA Aktiebolag, Vasteras, Sweden

[22] Filed: Sept. 4, 1975

[21] Appl. No.: 610,433

[30] Foreign Application Priority Data

Oct. 1, 1974 Sweden ..... 7412319

[52] U.S. Cl. ..... 200/148 D; 200/82 B

[51] Int. Cl.[2] ..... H01H 33/54

[58] Field of Search ..... 200/148 D, 148 B, 82 B, 200/148 R

[56] References Cited

UNITED STATES PATENTS

| | | | |
|---|---|---|---|
| 2,911,492 | 11/1959 | Beatty | 200/82 B |
| 3,043,940 | 7/1962 | Leeds | 200/148 D |
| 3,251,970 | 5/1966 | Gonek et al. | 200/148 D |

*Primary Examiner*—Robert S. Macon
*Attorney, Agent, or Firm*—Watson Cole Grindle & Watson

[57] ABSTRACT

An operating device for a high pressure circuit breaker enclosed in an elongated casing filled with compressed gas with a high-pressure chamber and a low-pressure chamber includes a driving arrangement operated by compressed gas. A compressed gas valve is provided for alternatively connecting the driving means to the high-pressure chamber and the low-pressure chamber. The device has openings into the high-pressure space and the low-pressure space respectively communicating with the driving arrangement. There is a valve seat around the first opening and a movable valve member engageable with the valve seat to close this opening. A space is provided on the opposite side of the valve member from the opening which is permanently connected with the high-pressure chamber. An impulse member outside the high-pressurechamber through an operating rod extending perpendicular to the longitudinal axis of the casing engages the valve member for moving the valve member away from the valve seat. Such movement closes the opening from the low-pressure chamber to the driving arrangement.

5 Claims, 2 Drawing Figures

OPERATING DEVICE FOR ENCLOSED HIGH VOLTAGE CIRCUIT BREAKERS

BACKGROUND OF THE INVENTION

1. Field of the Invention

The present invention relates to an enclosed high voltage compressed gas circuit breaker of the type which is enclosed in an elongated casing filled with compressed gas, preferably sulphur hexafluoride, comprising a high-pressure chamber and a low-pressure chamber, and with at least one movable contact and a blast valve.

The operating device for the contact and/or the blast valve comprises a driving means, which is operated by compressed gas and alternatively connectable to the high-pressure chamber and the low-pressure chamber by way of a compressed gas valve. This gas valve contains a movable valve member, which is one of its end positions seals against a valve seat arranged around a connection opening to said high-pressure chamber, and with at least part of its side — facing away from said connection opening — limits a space permanently communicating with the high-pressure chamber.

2. The Prior Art

For operation of compressed gas circuit breakers it is previously known (for example from U.S. Pat. Nos. 3,498,331 to Grune and 3,715,542 to Grune et al) to use a compressed gas valve, in which the movable valve member is constructed so that both sides of the member are permanently affected by the compressed gas. This results in the advantage that the force required for opening the valve can be considerably reduced. In the known constructions, however, the members for operating the valve are either constructed integrally with the movable valve member, which leads to a larger movable mass and thus to longer operating times, or they are built into the valve housing itself, which lessens the accessibility for control and service, in particular in the case of sulphur hexafluoride circuit breakers.

SUMMARY OF THE INVENTION

The object of the invention is to achieve, in a circuit breaker of the above-mentioned king, short breaking times (of the order of 1 to 1 ½ cycles) with an operating device of a simple and rugged construction. This is achieved by an operating device of the above-mentioned type, in which the valve member is displaceable from said valve seat by an impulse from an impulse member arranged outside the high-pressure chamber, the operating impulse being transmitted to the valve member by way of an operating rod directed substantially perpendicular to the longitudinal axis of the casing. In this construction, the control valve for the operating compressed gas can be placed close to the drive piston for the movable breaking contact, thus obtaining a short flow path for the operating compressed gas. At the same time, the impulse member for operating the control valve, which impulse member is often the most sensitive part of the operating device, may be placed outside the high-pressure chamber, which makes the impulse member more easily accessible for control and service. Since the operating rod is directed substantially perpendicular to the longitudinal axis of the casing, the rod can be made short, which contributes to reduce the breaking time.

BRIEF DESCRIPTION OF THE DRAWINGS

The invention will now be described in more detail with reference to the accompanying drawing, in which.

DESCRIPTION OF THE PREFERRED EMBODIMENTS

Figure 1:
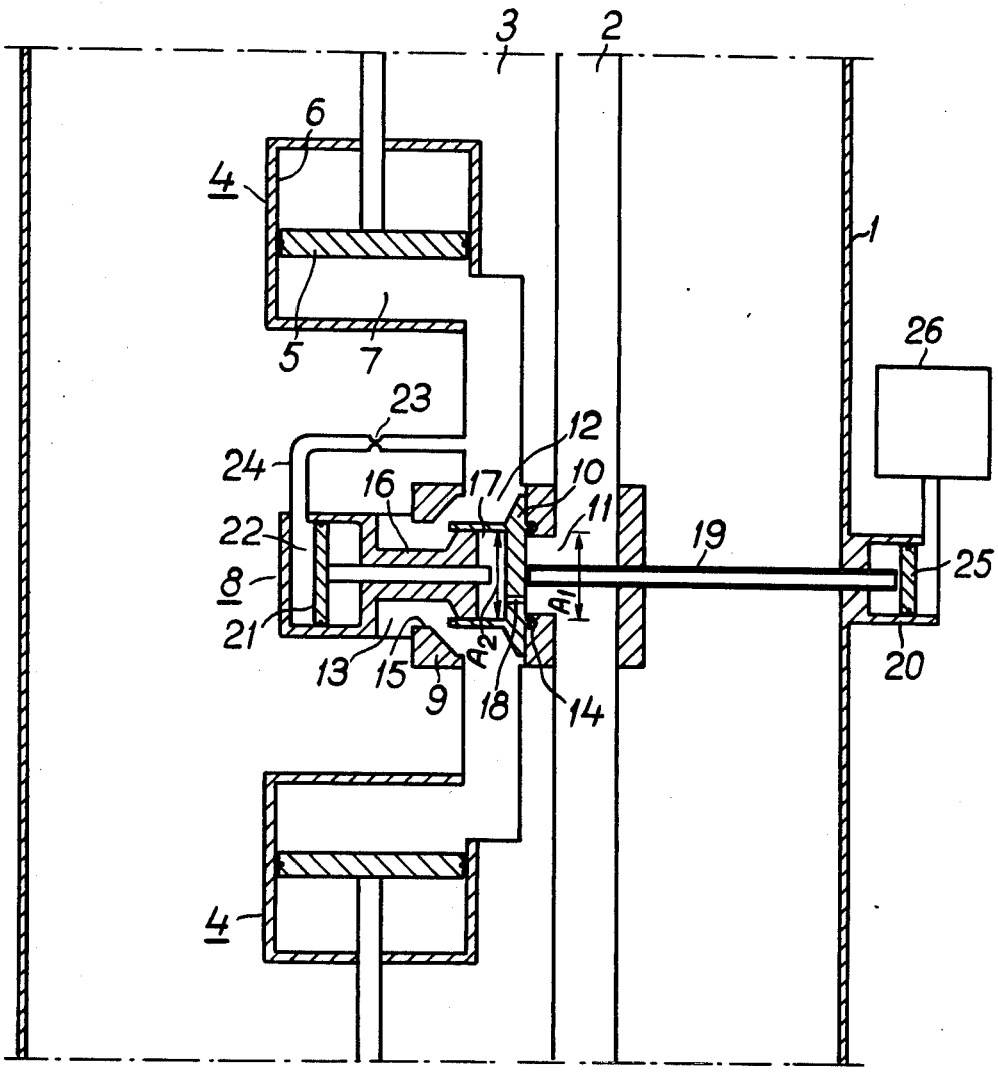
FIGS. 1 and 2 show two different embodiments of operating devices for high voltage circuit breakers.

FIG. 1 shows part of an elongated metal casing 1 comprising a high voltage compressed gas circuit breaker with two or more series-connected breaking elements (not shown). The casing contains a high-pressure chamber 2 in which the breaking elements, not shown, are arranged, and a low-pressure chamber 3 surrounding the high pressure chamber 2. All spaces in the casing 1 are filled with sulphur hexafluoride with a pressure of, for example, 1.7 MPa in the high-pressure chamber and 0.4 MPa in the low-pressure chamber. Upon breaking, the blast valves, not shown, of the breaking elements are opened, which causes gas to flow from the high-pressure chamber 2 to the low-pressure chamber 3. The arcs formed between the breaking contacts, which arcs are located in the gas stream, will then be rapidly deionized and extinguished. A compressor arranged between the low-pressure chamber and the high-pressure chamber will thereafter restore the original pressure difference.

For operation of the movable contact and blast valve of each breaking element there is arranged a driving means 4 operated by compressed gas and consisting of a drive piston 5 which is displaceable in a cylinder 6. The operation of the drive piston 5 and thus of the movable contact of the breaking element is performed by connecting the cylinder space 7 on the side of the piston 5 with the high-pressure chamber and the low-pressure chamber, respectively. This is achieved with the help of a control valve 8 which is common for two breaking elements arranged adjacent to each other. The valve 8 consists of a valve housing 9, in which there is arranged a movable valve member 10. The valve 8 is provided with an opening 11 which is connected to the high-pressure chamber 2, and with valve openings 12 which are connected to the compressed-gas-operated driving means 4 for the breaker contacts. 13 designates evacuation openings through which the cylinder space 7 of the driving means can be connected to the low-pressure chamber 3. The valve member 10 is movable between two end positions. In one (the righthand) end position, the valve member seals against a valve seat 14 arranged around the connection opening 11 to the high-pressure chamber, said valve seat enclosing an area $A_1$. At the other (lefthand) end position, the valve member seals against a cylinder surface 15 arranged in the inlet channel to the evacuation openings 13. On the side facing away from the connection opening 11, the valve member 10 is formed as a cylindrical cup protruding in the direction of operation, the internal cylindrical surface of said cup, which encloses an area $A_2$, sealing against a collared pin 16 axially directed in the valve housing. The space 17 which is thus limited by the end surface of the pin 16 and the valve member 10 is in permanent communication with the high-pressure chamber 2 through one or more openings 18.

The sealing pressure of the valve member 10 against the valve seat 14 is brought about by the pressure on the surface $(A_2 - A_1)$. For operation of the valve member there is arranged a rod 19 (or a tube) of insulating material (such as polyester-fibre-reinforced epoxy or $Al_2O_3$-filled epoxy) which leads almost radially from the casing cylinder 1 to the control valve 8.

A breaking operation is started by transferring an impulse from an impulse member 20 located outside the casing through the operating rod 19 to the valve member 10, which is thus lifted from the valve seat 14. The pressure in the high-pressure chamber 2 will then act on the entire end surface of the valve member, which end surface is considerably larger than the area $A_1$ enclosed by the valve seat 14, the valve member thus being rapidly transferred to its lefthand end position, and high-pressure gas flows into the cylinder space 7 of the driving means and sets the drive pistons 5 in motion. After a certain time, the valve member 10 is automatically returned to its righthand end position with the help of a return piston 21 built into the valve housing. This piston is operated by leading high-pressure gas into a space 22 located to the left of the piston through a conduit 24 provided with throttling means 23, the piston 21 thus being moved to the right.

In order to set the rod 19 in motion inwardly, different types of impulse members can be used. FIG. 1 shows schematically an impulse member which is suitable for circuit breakers with modest demands on breaking times (2-cycle circuit breakers). In this case the impulse member consists of a piston 25 located outside the casing 1, which piston 25 may be subjected to a pressure impulse by opening a so-called pilot valve arranged between the piston and a pressure medium container 26.

Figure 2:
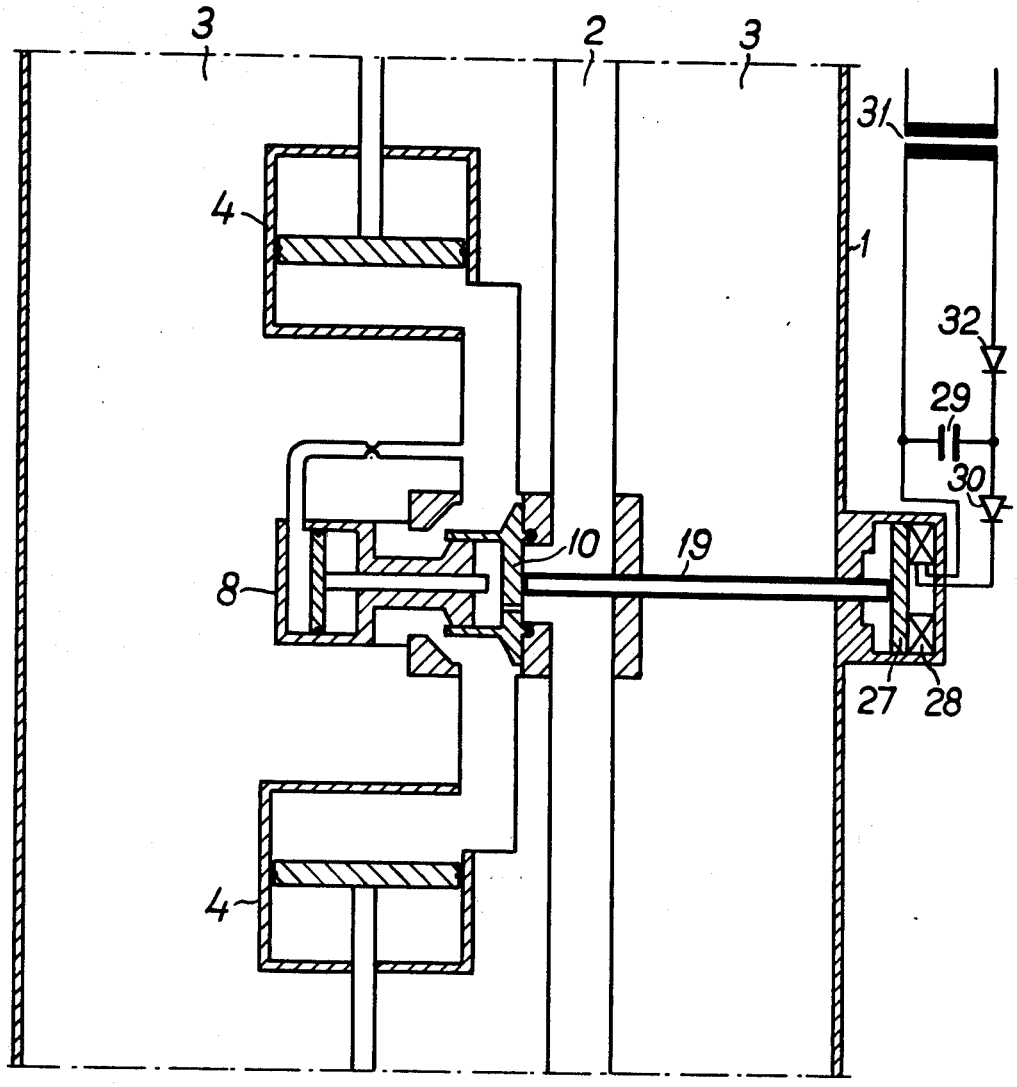

In FIG. 2 is shown an impulse member for extremely fast circuit breakers. The outer end of the operating rod is here provided with a so-called kick-plate 27, that is a disc of copper or aluminium which is repulsed by a current surge through a flat coil 28 close to the surface of the plate. The current surge is achieved by discharging a capacitor 29 across a thyristor 30. The capacitor is charged through a transformer 31 and a diode 32. The kick-plate 27 need not be attached to the operating rod. Preferably, the plate is placed outside the casing 1, but it is also possible to arrange it inside the casing.

We claim:

1. An operating device for a high-voltage circuit breaker enclosed in an elongated casing (1) filled with compressed gas and comprising a high-pressure chamber (2) and a low-pressure chamber (3), a driving means (4) operated by compressed gas and including a pressure chamber (7), a compressed gas valve means (8) for alternatively connecting said driving means to the high-pressure chamber and the low-pressure chamber, said valve means having first and second openings (11,13) into the high-pressure chamber and the low-pressure chamber, respectively, communicating with the pressure chamber, a valve seat (14) around the first opening, a movable valve member (10) engageable with said valve seat to close the first opening, means (17) forming a space on the opposite side of the valve member from the first opening, means (18) permanently connecting said space with the high-pressure chamber, an impulse member (20) outside the high-pressure chamber, an operating rod (19) extending substantially perpendicular to the longitudinal axis of the casing operatively connected to the impulse member and the valve member for moving the valve member away from the valve seat, and means responsive to movement of the valve member away from the valve seat to close the second opening.

2. An operating device according to claim 1, in which said impulse member (20) is arranged outside the casing (1).

3. An operating device according to claim 1, in which said impulse member (20) comprises a piston (25) displaceably arranged in a compressed gas cylinder.

4. An operating device according to claim 1, in which said impulse member (20) comprises a stationary coil (28) connectable to an energy accumulator (29) and a metal plate (27) inductively connected to the coil for operation of the operating rod (19).

5. An operating device according to claim 1, in which said valve (8) contains a piston (21) operated by compresed gas for automatically returning the movable valve member (10) to its initial position after an operation.

* * * * *